US006727857B2

(12) United States Patent
Mikkola et al.

(10) Patent No.: US 6,727,857 B2
(45) Date of Patent: Apr. 27, 2004

(54) MULTIBAND ANTENNA

(75) Inventors: Jyrki Mikkola, Kempele (FI); Petteri Annamaa, Oulunsalo (FI); Suvi Tarvas, Oulu (FI); Mari Paunuma, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/150,583

(22) Filed: May 17, 2002

(65) Prior Publication Data

US 2002/0171592 A1 Nov. 21, 2002

(30) Foreign Application Priority Data

May 17, 2001 (FI) ..... 20011043

(51) Int. Cl.[7] ..... H01Q 1/24

(52) U.S. Cl. ..... 343/702; 343/700 MS; 343/770

(58) Field of Search ..... 343/702, 700 MS, 343/767, 770, 846, 725

(56) References Cited

U.S. PATENT DOCUMENTS 4,929,961 A 5/1990 Nakase ..... 343/715
6,252,552 B1 * 6/2001 Tarvas et al. ..... 343/700 MS
6,252,554 B1 6/2001 Isohatala et al. ..... 343/700
6,346,914 B1 * 2/2002 Annamaa ..... 343/700 MS
6,348,892 B1 * 2/2002 Annamaa et al. .... 343/700 MS
2001/0048391 A1 * 12/2001 Annamaa et al. ..... 343/702

FOREIGN PATENT DOCUMENTS

EP 0790663 8/1997 ..... H01Q/1/24

* cited by examiner

*Primary Examiner*—Hoang Nguyen
(74) *Attorney, Agent, or Firm*—Darby & Darby

(57) ABSTRACT

The invention relates to a multiband antenna which finds utility particularly in mobile stations. The antenna structure includes a PIFA-type antenna positioned inside the covers of a mobile station, which antenna includes a slot radiator (231). In the planar element there is a second slot (232) so that, viewed from a feed point (F), two radiating conductive branches (B1, B2) of different lengths are formed. Each of the three radiators has a separate operating band of its own. The structure also includes a whip element (211) movable with respect to the PIFA part. When the whip element is pulled out, its lower end is galvanically coupled with the shorter branch of the planar element, with its relatively narrow side branch (B12). The whip enhances the operation of the antenna especially in the lowest operating band. The influence of the pulled-out whip on the location of the uppermost operating band is compensated for by a third slot (233) in the planar element. Matching for the whip element is provided by shaping the conductive patterns existing in the planar element in any case. The structure is relatively simple and economical to fabricate. A good three-band planar antenna can be provided without a whip element as well.

8 Claims, 4 Drawing Sheets

MULTIBAND ANTENNA

The invention relates to a multiband antenna which finds utility particularly in mobile stations.

In the field of portable radio equipment, mobile stations in particular, fabrication of antennas has become more demanding than before. As new frequency bands are introduced, an antenna often has to function in two or more frequency bands. For convenience, the antenna is preferably placed inside the covers of the apparatus. Understandably, however, the radiation characteristics of an internal antenna are somewhat weaker that those of an external antenna. This disadvantage can be reduced using a double-action antenna so that a movable antenna element belonging to the structure can be pulled partly out from the apparatus when necessary, in order to improve the quality of network connection. On the other hand, the increase in the number of radiating structural components means more matching problems.

Figure 1:
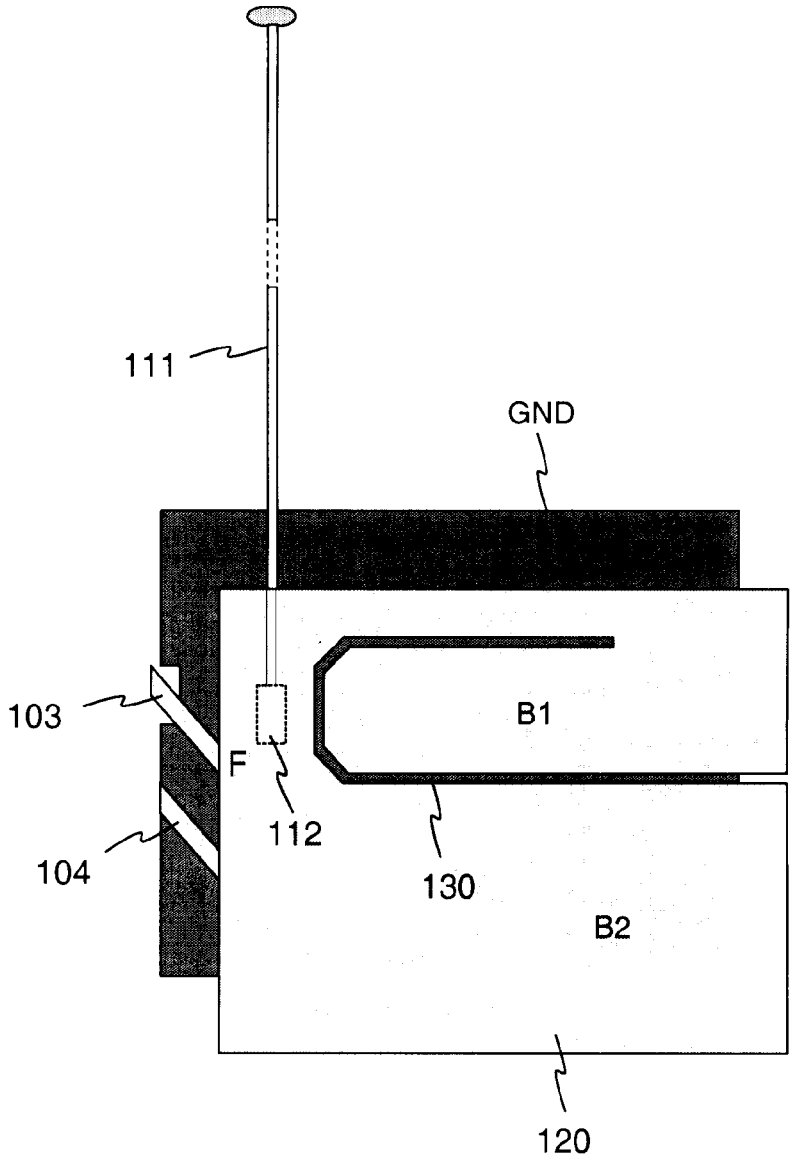
Fig. 1 PRIOR ART

An antenna with satisfactory characteristics which fits inside a small device is in practice most easily implemented as a planar structure: The antenna comprises a radiating plane and a ground plane parallel therewith. The number of operating bands can be increased to two by dividing the radiating plane into two branches of different lengths, as viewed from the feed point. The structure shown in FIG. 1, disclosed in patent application publication F1991359, represents such a known antenna. It comprises a ground plane GND, radiating planar element 120, feed conductor 103 of the latter, and a short-circuit conductor 104 which connects the radiating plane to the ground plane. So, considering this construction, the antenna is a so-called planar inverted F antenna (PIFA). The planar element 120 includes a slot 130 starting from the edge of the planar element and ending in the inner area of the planar element after a U-shaped bend. The feed point F of the planar element is near the U bend of the slot 130. Viewing from the feed point, the first branch B1 of the planar element which curves inside the U bend is electrically clearly longer than the second branch B2 at the other side of the planar element. Thus the PIFA has got two separate resonance frequencies and respective operating bands. The antenna structure of FIG. 1 further comprises a movable whip element 111, at the lower end of which there is a conductive connecting part 112. When the whip is in its lower position, it has no significant coupling with the PIFA parts. When the whip is in its upper position, as shown in FIG. 1, the connecting part 112 is in galvanic contact with the radiating planar element 120 near its feed point F. So, the whip element is fed via the planar element. The dimensions of the whip element are such that it resonates in the lower operating frequency band of the PIFA part, where it improves the electrical performance of the antenna. The whole structure thus has two operating bands. If one would attempt to provide a third operating band using e.g. a whip element, there would be matching problems and the antenna characteristics at least in one operating band would be unsatisfactory. A third operating band could be provided by a separate radiating element and antenna port but this would be space-consuming and require additional costs.

From patent application publication F1990006 it is known to use a slot radiator to provide a second operating band for an antenna. The publication discloses a PIFA-type antenna where the radiating planar element includes a slot extending from the edge to the middle region. The feed and short-circuit points of the antenna are close to the open end of the slot. The dimensions of the slot are such that it resonates in the upper one of the intended operating bands. The conductive planar element naturally resonates in the other, lower operating band. This antenna structure, too, has only got two operating bands. Moreover, to add a whip element in the known manner would result in matching problems in the operating bands of the PIFA.

An object of the invention is to realize in a new, more advantageous manner a mobile station antenna which has at least three useful operating bands. An antenna structure according to the invention is characterized by that which is specified in the independent claim 1. Some advantageous embodiments of the invention are presented in the dependent claims.

The basic idea of the invention is as follows: The antenna structure includes a PIFA-type antenna placed inside the covers of a mobile station, which antenna has a slot radiator formed by a first slot starting from near the feed and short-circuit points of the planar element. In addition, the planar element has a second slot so that, viewed from the feed point, there are formed two radiating conductive branches of different lengths. Each of the three radiators has a separate operating band of its own. The structure further includes a whip element movable in relation to the PIFA part. When pushed in, the whip element has no significant coupling with the antenna feed or PIFA parts. When pulled out, the lower end of the whip element is galvanically coupled to the shorter branch of the planar element. For this coupling, the shorter branch has a relatively narrow side branch. The dimensions are chosen such that the whip enhances the operation of the antenna especially in the lowest operating band. The influence of the pulled-out whip on the location of the uppermost operating band is compensated for by a third slot made in the planar element, with which third slot at the same time the shorter branch of the planar element is shaped.

An advantage of the invention is that the whip element enhancing the operation of the antenna can be coupled without any special matching arrangements. Matching is done by shaping the conductive patterns that exist in the planar element in any case. From this it follows that a structure according to the invention is relatively simple and economical to fabricate. Another advantage of the invention is that it provides a useful three-band planar antenna without a whip element, too.

Figure 3:
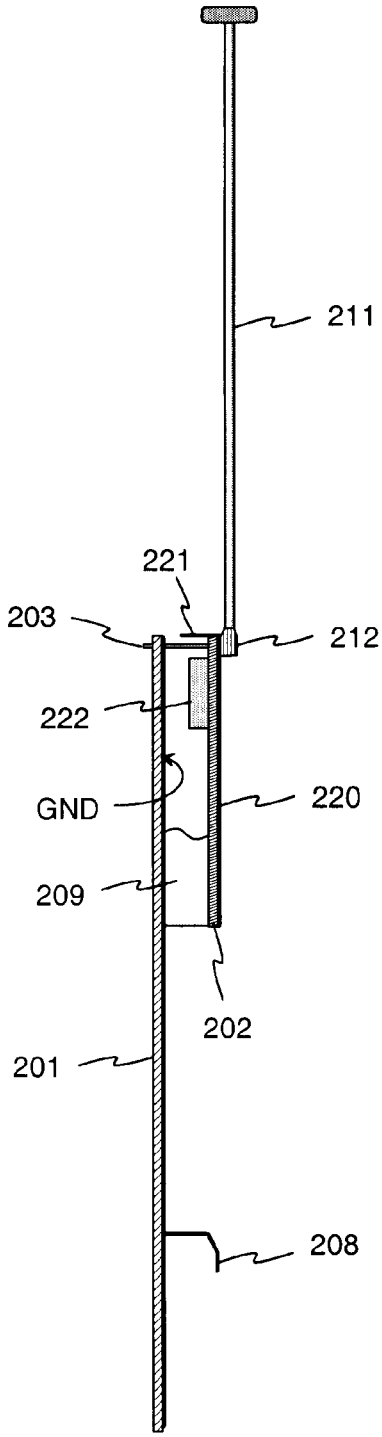
Figure 4:
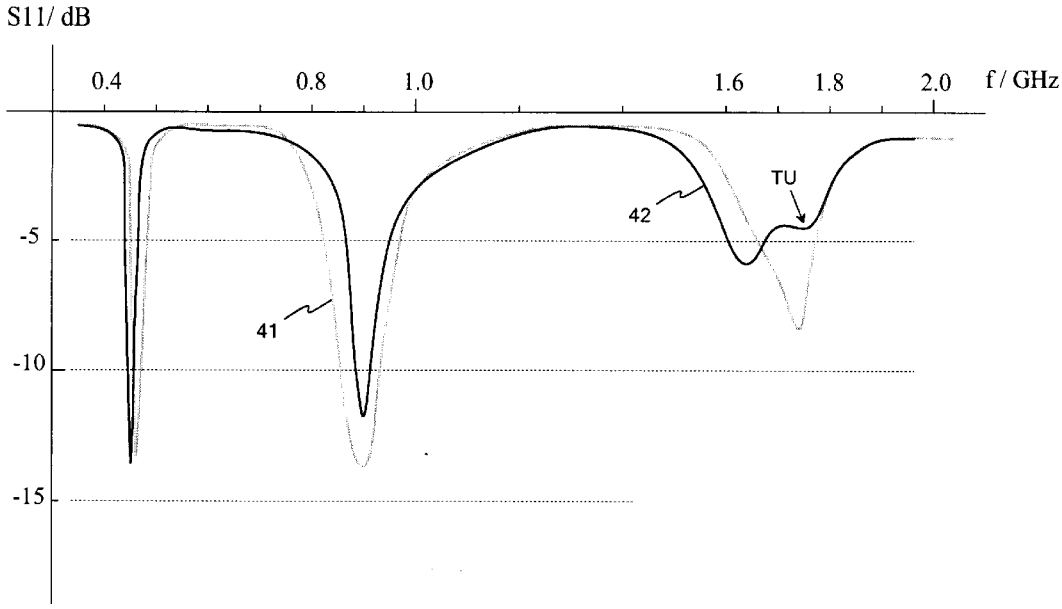
Figure 5:
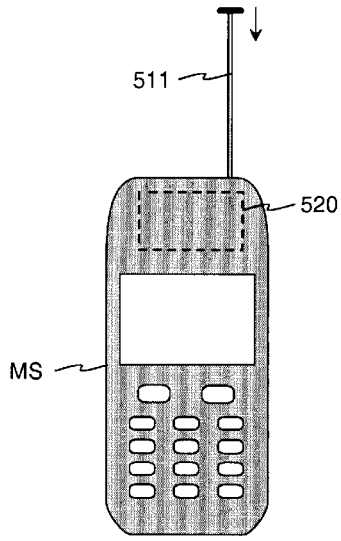

The invention is below described more closely. Reference is made to the accompanying drawings in which FIG. 1 shows an example of a prior-art antenna structure, FIG. 2 shows an example of an antenna structure according to the invention, FIG. 3 shows the structure of FIG. 2 in a lateral view, FIG. 4 shows an example of the frequency characteristics of an antenna according to the invention, and FIG. 5 shows an example of a mobile station equipped with an antenna according to the invention.

FIG. 1 was already discussed in conjunction with the description of the prior art.

Figure 2:
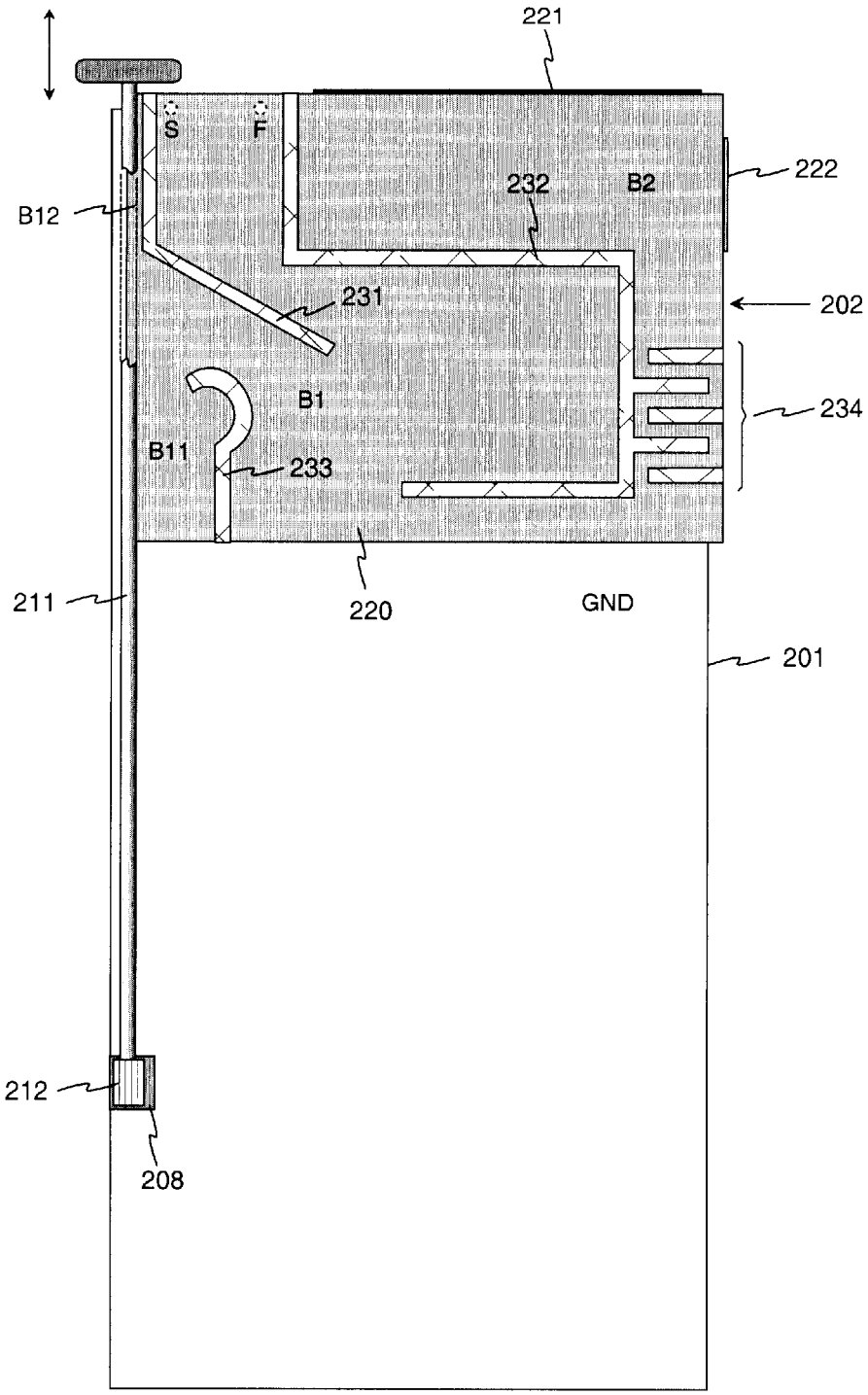

FIG. 2 shows in magnification an example of an antenna structure according to the invention. The antenna has three operating bands: a first, or uppermost, band, a second, or middle, band, and a third, or lowest, band. The antenna structure comprises a ground plane GND, a radiating planar element 220 parallel therewith and a whip element 211 on one side of the planar element. In this example, the ground plane is a conductive layer on a surface of a circuit board 201 in the radio apparatus in question. The ground plane could also be part of the frame of the radio apparatus, for example. In this example, the radiating planar element is a conductive layer on an antenna circuit board 202. It could also be a rigid conductive plate. The antenna circuit board is supported such that it is to some extent elevated from the larger circuit board 201 of the radio apparatus. In galvanic contact with the radiating planar element 220 at its point F there is the feed conductor of the whole antenna structure, and at another point S, relatively close to the feed point, there is a short-circuit conductor which connects the radiating planar element to the ground plane. Thus the planar portion of the antenna structure is of the PIFA type. In the planar element 220 there is a first slot 231 which starts from the upper edge of the element, near the short-circuit point S, and ends in the center area of the planar element. The dimensions of the first slot are such that together with the surrounding conductive plane and ground plane it forms a quarter-wave resonator and functions as a radiator in the uppermost operating band of the antenna. In the planar element 220 there is also a second slot 232 which starts from the upper edge of the element, near the feed point F, and ends after three rectangular bends at the lower part of the planar element. The second element divides the planar element, viewed from the feed area, into a first branch B1 and second branch B2. The first branch is at the same time largely the starting end of the second branch. The dimensions of the first branch are such that together with the ground plane it forms a quarter-wave resonator and functions as a radiator in the middle operating band of the antenna. The dimensions of the second branch B2 are such that together with the ground plane it forms a quarter-wave resonator and functions as a radiator in the lowest operating band of the antenna. To adjust the exact location of the resonance frequency the second branch includes additional bends formed by short slots 234 starting perpendicularly from the right edge and extensions of the second branch 232 positioned in between these slots. In addition, the electrical length of the second branch is increased by means of conductive plates 221 and 222, directed from the planar element 220 towards the ground plane at the open end of the second branch, increasing the capacitance there.

The first branch B1 further branches into two parts on the left side of the planar element, where the whip element 211 is placed. The larger sub-branch B11 is directed downwards and it is confined, in addition to the edges of the planar element, by the third slot 233 of the planar element which starts from the lower edge of said element. The second sub-branch B12, which is narrower and shorter, is directed upwards, and is confined, in addition to the edges of the planar element, by the first slot 231 of the planar element.

The whip element 211 is movable in the direction of its axis. In FIG. 2 the whip element is shown in its lower position, i.e. pushed in the radio apparatus. In that position it has no significant coupling with the rest of the antenna structure, i.e. the planar antenna. The conductive connecting part 212 in the lower end of the whip element is in galvanic contact with the ground plane through a projection 208 in the ground plane, which reduces unwanted coupling with the planar antenna. Part of the upper portion of the whip element is drawn transparent in order to provide a better view of the underlying second sub-branch B12 of the first branch.

FIG. 3 shows the antenna structure of FIG. 2 viewed from the whip element side. There is shown the larger circuit board 201 of the radio apparatus and the antenna circuit board 202. The latter is separated from the former at a suitable distance and attached thereto by means of a dielectric frame 209. The whip element 211 is shown in its upper position, i.e. pulled out. In that position the connecting part 212 at its lower end is in galvanic contact with the end of the second sub-branch B12 of the first branch of the planar element 220. The length of the whip element is chosen such that together with the first branch of the planar element and the ground plane it constitutes a quarter-wave resonator and functions as radiator in the lowest operating band of the antenna. Thus a pulled-out whip element improves the radiation and reception characteristics of the antenna in the lowest band. The lower the lowest band, the more important this is, because as the frequency gets lower, it becomes more difficult to fabricate a good enough internal antenna.

A pulled-out whip element affects the tunings of the planar antenna. The affect on the middle band is reduced by arranging the whip connecting point at the end of the narrow side branch B12 as described above. In practice the effect is the greatest on the uppermost band which tends to shift downwards. In accordance with the invention this is prevented as follows: Said third slot 233 in the planar element is placed and designed such that as the whip is pulled out, a resonance is invoked there at a frequency which is higher than the center frequency of the uppermost operating band specified for the antenna. Thus the operating band formed by the first slot 231 and third slot 233 still covers the specified operating band, i.e. the matching in the operating band is retained. The operating band just becomes wider.

FIG. 3 further shows said extensions of the second branch B2 of the planar element, i.e. the conductive plates 221 and 222 directed towards the ground plane. Furthermore, FIG. 3 shows the end of the feed conductor 203 of the whole antenna structure on the outer surface of the circuit board of the radio apparatus, and a short-circuit conductor between the circuit board of the radio apparatus and the antenna circuit board. Also shown is a ground plane projection 208 which connects the whip element, in the lower position, to the ground plane.

The attributes "lower" and "upper" as well as "right" and "left" refer in this description and in the claims to the position of the antenna structure as it is depicted in FIG. 2; they are not in any relation with the operating position of the apparatus.

FIG. 4 shows an example of the frequency characteristics of an antenna structure corresponding to FIGS. 2 and 3. Shown in the figure are curves of reflection coefficient S11 as a function of frequency. Curve 41 shows the change in the reflection coefficient when the whip element is in the pushed-in position, and curve 42 shows the change in the reflection coefficient when the whip element is in the pulled-out position. The structural dimensions are selected such that the lowest operating band is the band required by the GSM 450 system (Global System for Mobile Telecommunications), the middle operating band is the band required by the GSM 900 system, and the uppermost band is the band required by the PCN system (Personal Communication Network). Comparing the curves we can see that pulling-out of the whip element results in a small shift downward in the lowest band, narrowing of the middle band, and widening of the uppermost band. The arrangement according to the invention which was mentioned in the description of FIG. 3 is used to prevent the uppermost band from shifting downward. This would happen without the third slot 233 in the planar element 220. In FIG. 4 the effect of the tuning realized with the third slot is shown by the reference arrow TU.

Pulling-out of the whip element naturally enhances the efficiency of the antenna structure in transmitting and receiving. This does not appear in the reflection coefficient curves.

FIG. 5 shows a mobile station MS equipped with an antenna structure according to the invention. A multiband radiating planar element 520, which belongs to the structure, is located entirely inside the covers of the mobile station.

The whip element 511 is shown completely pulled out from within the covers of the mobile station.

Above it was described an antenna structure according to the invention. The invention does not restrict the designs of the antenna elements to those described. Nor does the invention restrict the method of fabrication of the antenna or the materials used therein. The inventional idea may be applied in different ways within the scope defined by the independent claim 1.

What is claimed is:

1. A multiband antenna comprising a ground plane and radiating planar element inside a radio apparatus, which planar element includes an antenna feed point, a short-circuit point, a planar element short-circuit point, and a first slot, which starts from the edge of the planar element, relatively near the short-circuit point, the first slot being arranged to resonate in a first operating band of the antenna, the antenna further comprising a whip element movable with respect to the planar element, which whip element, when extended, has a galvanic connecting point with the planar element, said planar element further including second and third slots starting from the edge of the planar element, which second slot divides the planar element, viewed from its feed point, into a first branch being arranged to resonate in a second operating band of the antenna, and into a second branch being arranged to resonate in a third operating band of the antenna, said third slot being arranged to resonate, when the whip element is extended, at a frequency which is higher than the center frequency of the first operating band of the antenna in order to provide matching for the antenna within the range of the first operating band.

2. An antenna according to claim 1, said whip element together with the first branch being arranged to resonate in the third operating band of the antenna.

3. An antenna according to claim 1, the first branch further branching into two sub-branches, the second of which is confined by the edges of the planar element and the first slot, said whip element connecting point being located at the end of the second sub-branch.

4. An antenna according to claim 3, wherein of the sub-branches of the first branch, the first sub-branch is confined by the edges of the planar element and the third slot.

5. An antenna according to claim 1, said feed point and short-circuit point being located between the first slot and second slot.

6. An antenna according to claim 1, the second branch including at least one projection directed towards the ground plane in order to increase the electrical length of the second branch.

7. An antenna according to claim 1, the lower end of the whip element being galvanically coupled to the ground plane when the whip element is retracted inside the radio apparatus.

8. A mobile station having an antenna structure which comprises a multiband radiating planar element and a ground plane as well as a whip element movable with respect to these two, which whip element, when extended, has a galvanic connecting point with the planar element which planar element has an antenna feed point, a short-circuit point, and a first slot starting from the edge of the planar element, relatively near the short-circuit point, the first slot being arranged to resonate in a first operating band of the antenna, said planar element further including second and third slots starting from the edge of the planar element, which second slot divides the planar element, viewed from its feed point, into a first branch being arranged to resonate in a second operating band of the antenna, and into a second branch being arranged to resonate in a third operating band of the antenna, said third slot being arranged to resonate, when the whip element is extended, at a frequency which is higher than the center frequency of the first operating band of the antenna in order to provide matching for the antenna within the range of the first operating band.

* * * * *